United States Patent [19]

Logie

[11] 4,322,053

[45] Mar. 30, 1982

[54] FITTING ROOM MIRROR BRACKET

[75] Inventor: Charles F. Logie, Spring Lake, Mich.

[73] Assignee: American Store Equipment Company, Muskegon, Mich.

[21] Appl. No.: 155,964

[22] Filed: Jun. 3, 1980

[51] Int. Cl.[3] ..... A47F 7/14

[52] U.S. Cl. ..... 248/488; 248/201; 248/220.1; 52/27

[58] Field of Search ..... 248/201, 220.1, 466, 248/475 R, 488, 490, 491; 52/35, 38, 288, 27; 108/42; 312/224, 238

[56] References Cited

U.S. PATENT DOCUMENTS

| | | | |
|---|---|---|---|
| 1,059,039 | 4/1913 | Corbitt | 248/466 |
| 1,599,654 | 9/1926 | Cranston | 248/220.1 |
| 2,096,024 | 10/1937 | Anderson | 248/220.1 X |
| 2,219,975 | 10/1940 | Bentz | 248/220.1 |
| 2,389,349 | 11/1945 | Eastman | 108/42 |
| 2,991,577 | 7/1961 | Bellocchio | 248/466 |
| 3,194,527 | 7/1965 | Gruss | 248/235 |
| 3,203,142 | 8/1965 | Narmore | 52/27 |
| 3,478,997 | 11/1969 | Goss | 248/490 X |
| 3,582,614 | 6/1971 | Zellers | 248/488 X |
| 3,679,164 | 7/1972 | Bard | 248/243 |
| 3,692,265 | 9/1972 | Barriger | 248/220.1 |

*Primary Examiner*—William H. Schultz

*Attorney, Agent, or Firm*—Price, Heneveld, Huizenga & Cooper

[57] ABSTRACT

The specification discloses a fitting room mirror assembly in which the mirror is mounted at an angle in a corner of a fitting room using upper and lower nonapertured mounting brackets at the mirror's top and bottom respectively. Each mounting bracket comprises a nonapertured triangular plate, two edges of which fit snugly against the two walls of the corner while the third edge receives the mirror so that access to the space behind the mirror is prohibited.

26 Claims, 5 Drawing Figures

FITTING ROOM MIRROR BRACKET

BACKGROUND OF THE INVENTION

The present invention relates to fitting room mirrors, particularly those mounted at an angle in a corner of a fitting room. Many clothing stores have serious problems with thievery. Utilizing a fitting room with a conventionally mounted corner mirror, a thief can abscond with new clothes by taking them into the room, removing their price tags and labels, changing into the new clothes, concealing his old clothes and the tags and labels from the new clothes behind the fitting room mirror and walking out of the store leaving no evidence of his crime. Some even put the new clothes over the old and simply hide the tags and labels behind the mirror. Although it is preferable to have an angled mirror in the corner of a fitting room to enable the honest customer to fully view a prospective clothing purchase, the potential for thievery makes this impractical. It is too easy to hide tags and old clothes behind the mirror. Therefore, many fitting rooms now have mirrors which are mounted flatly against the wall so that no clothing may be hidden behind them. This placement of the mirrors flat against the wall is irritating to some customers who wish to view their clothes from more than one angle, which is difficult to do with such placement in a small fitting room. Further, it is often still possible to slide tags and labels behind the mirror.

Artisans have either not attempted or been unable to solve the problem of placing a mirror at an angle in the corner of a fitting room while at the same time preventing access to the space behind the mirror. Prior art corner shelves which might be suitable for use in mounting a wall mirror have either some type of hole through them or gaps along their edges where they are mounted against the wall. Examples of such shelves can be seen in U.S. Pat. Nos. 2,096,024 and 2,389,349. In addition to the holes in the surface of U.S. Pat. No. 2,096,024, a significant gap is created in the corner of both shelves. All of these apertures are large enough to push price tags and labels through. However, even if the thief can hide only the price tags and labels from the new clothes without being able to hide his old clothes, he may still commit the larceny by walking out of the fitting room wearing the new clothes over his old clothes. This is especially true of outerwear such as coats and jackets.

SUMMARY OF THE INVENTION

In the present invention, access to the space behind a mirror mounted diagonally across a corner of a fitting room is prevented through the use of inexpensive mounting brackets. A pair of these brackets is installed in the corner of the fitting room, one above the other, with the mirror supported between them. Each bracket comprises a generally flat, nonapertured plate generally triangular in shape. Securing means are provided on two edges of each plate to attach the bracket to the two walls of the corner of the fitting room. Receiving means are provided on the third edge of each plate to secure and support either the top or bottom edge of the mirror. This third edge is substantially the same length as the mirror to be supported thereby so that the vertical edges of the installed mirror will be held securely against the fitting room walls. When the mirror is installed using the brackets of the present invention, access to the space behind the mirror is blocked (1) at top and bottom by the mounting brackets which are sealed on their three sides by the two walls and the mirror and (2) at the sides by the mirror which is held securely against the walls.

These and other objects, advantages and features of the invention will be more fully understood and appreciated by reference to the written specification and appended drawings.

DESCRIPTION OF THE PREFERRED EMBODIMENT

Figure 4:
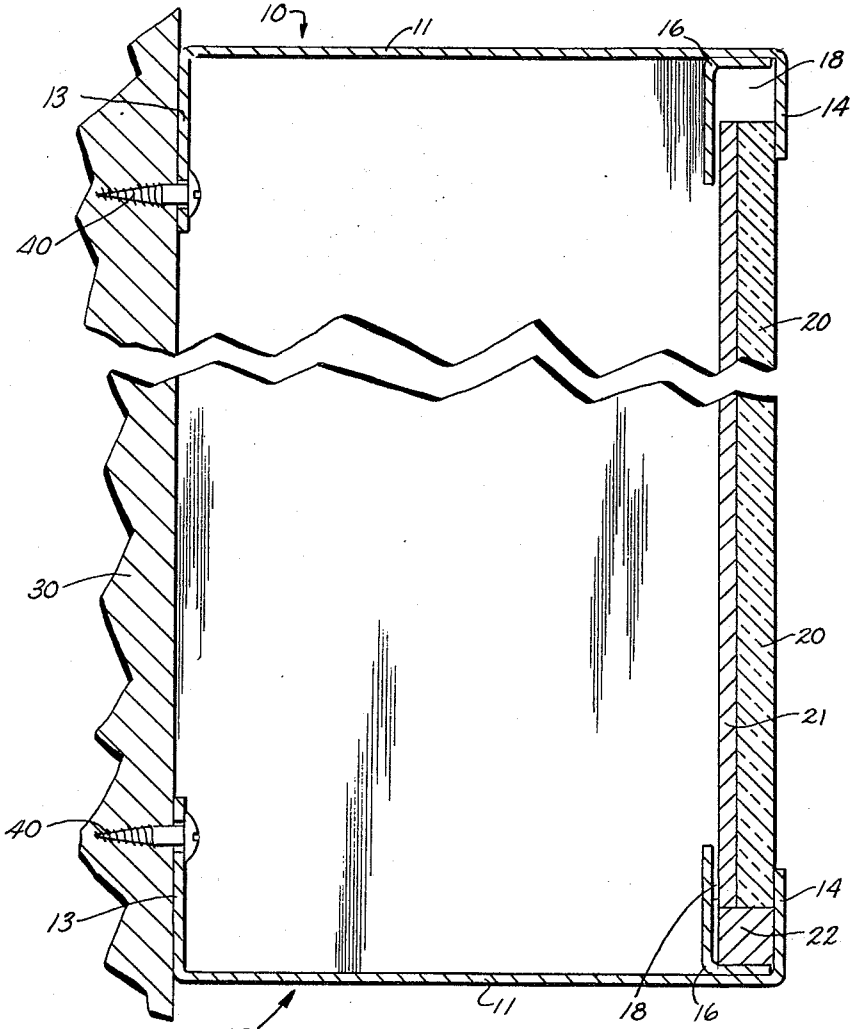
FIG. 4 is a cross-sectional view of the installed mirror taken along vertical plane IV—IV of FIG. 2, showing the mirror and mirror backer installed using the mounting brackets of the present invention.
Figures 2, 3, 5:
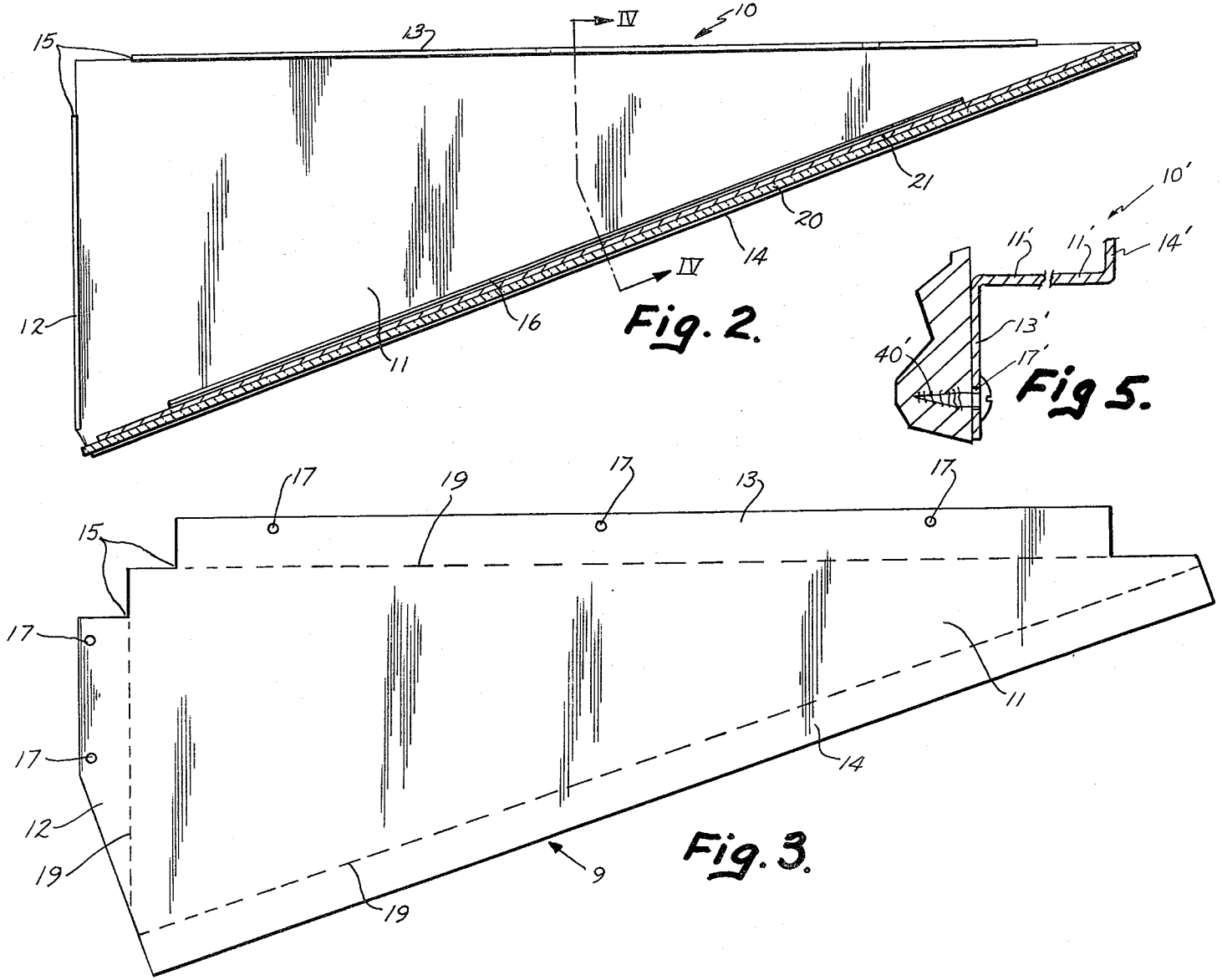
FIG. 2 is a cross-sectional view of the installed mirror taken along horizontal plate II—II of FIG. 1, showing the lower mounting bracket with the installed mirror.
FIG. 3 is a top view of the blank from which the mounting bracket is formed.
FIG. 5 is a fragmentary view of an alternative embodiment of the lower mounting bracket shown in FIG. 4.

In the preferred embodiment, the mounting bracket 10 has a generally triangular shape defined by plate 11 (FIGS. 2, 3 and 4). A downwardly bent mirror flange 14 runs along the hypotenuse of plate 11 while a downwardly bent side flange 12 and rear flange 13 run along the other two sides of plate 11. These three flanges are formed by bending the edges of blank 9 along the three bend lines 19 so that the three flanges are generally perpendicular to plate 11. Blank 9 is made of a material of sufficient strength and rigidity to support a mirror, preferably 16 gauge cold-rolled steel. A mirror retaining angle iron 16, also formed of 16 gauge cold-rolled steel or equivalent, is mounted on plate 11 adjacent to and parallel to the mirror flange 14, so as to define a mirror retaining channel 18. Preferably, the downwardly (or upwardly, depending on orientation of bracket 10) depending wall of angle iron 16 extends beyond the terminal edge of flange 14 to facilitate mounting mirror 20 as hereinafter explained.

Both side flange 12 and rear flange 13 contain a plurality of attaching holes 17 which receive screws 40 used to attach the flanges to the walls. Both side flange 12 and rear flange 13 extend downwardly (or upwardly, depending on the orientation of bracket 10) beyond the terminal edge of the downwardly (or upwardly, depending on the orientation of bracket 10) depending wall of angle iron 16 a sufficient distance so that attaching holes 17 are also located beyond the terminal edge of the depending wall of angle iron 16. Such location of attaching holes 17 facilitates attachment of the bracket to the walls because the blade of a screwdriver used to drive screws 40 can be positioned flat against the heads of screws 40.

The corner point 15 enables the complete sealing of the bracket against the corner. Prior art corner brackets and shelves do not include this sealing point, apparently so that problems with fitting these brackets and shelves into the corner are alleviated. However, without corner point 15, small articles such as price tags and labels may be hidden behind the mirror.

The corner point 15 is formed when the blank is cut by removing a portion, here approximately 1", of side flange 12 and rear flange 13. This creates a very thin space on each side of corner 15 which will accommodate installation of the bracket in an imperfectly square corner. Therefore, the corner point 15 varies slightly from being square with respect to side and rear flanges 12 and 13 to facilitate the bracket's installation in corners which are imperfect, but the variation must be slight enough so that corner point 15 still fits sufficiently snugly into the corner to prevent one from pushing tags and labels around it. Preferably, such variation is no greater than the thickness of the metal of side and rear flanges 12 and 13.

Figure 1:
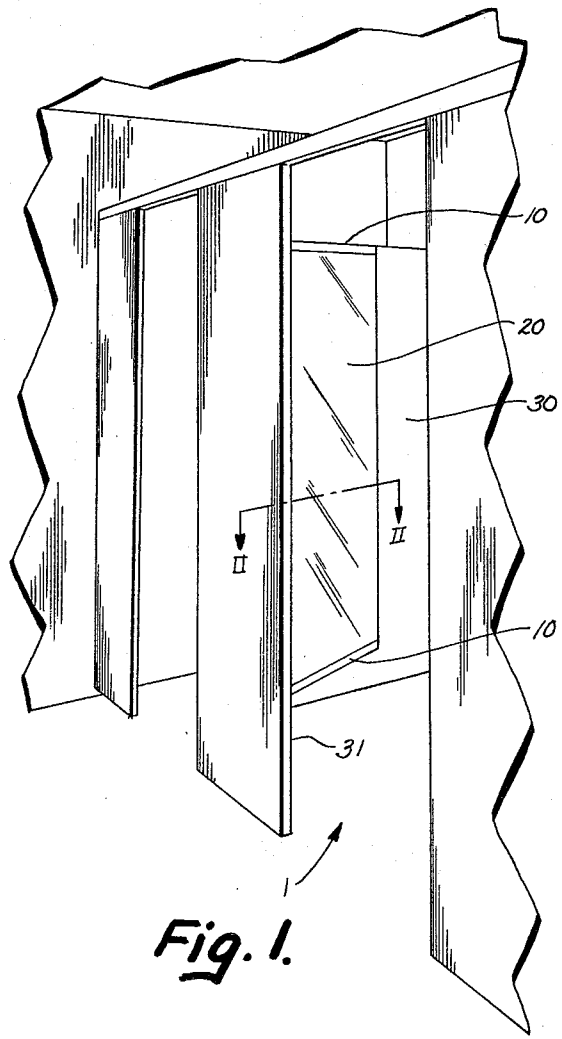
FIG. 1 is a perspective view through the open door of a fitting room with a mirror installed using the brackets of the present invention.

Referring to FIGS. 1 and 4, mirror 20 is installed using two oppositely mounted brackets 10. Rear flange 13 of each bracket is attached to rear wall 30 of the dressing room and side flange 12 is attached to side wall 31 of the dressing room. These attachments are performed using screws 40 which pass through attaching holes 17 and into the walls 30 and 31. A hardboard channel filler 22 is then placed in retaining channel 18 of the lower bracket in order to provide a shock absorbing material upon which mirror 20 rests. Channel filler 22 extends the full width and length of retaining channel 18 but not the full height; thus retaining channel 18 may still receive the edge of mirror 20 and mirror backer 21.

Finally, mirror backer 21 and the mirror 20 are fitted into the retaining channels 18 of the upper and lower brackets. Top bracket 10 is spaced above bottom bracket 10 a distance such that one can slide mirror 20 up into top channel 18, swing the bottom of mirror 20 past the top of bottom flange 14 until it hits the depending portion of angle iron 16 and then slide it down into bottom channel 18. Suction cup handles are used to facilitate this operation.

Because brackets 10 are reversible, mirror 20 can be mounted in any corner of the fitting room at either of two angles. Once installed, plate 11 with corner point 15 prevents one who is using the fitting room from stuffing clothes, price tags or lables behind mirror 20.

A fragmentary view of an alternative embodiment 10' of bracket 10 is shown in FIG. 5 wherein rear flange 13' (as well as the side flange) is bent in a direction opposite to that of mirror flange 14'. When brackets 10' are used to install a mirror, rear flanges 13' (as well as the side flanges) of upper and lower brackets 10' extend outwardly from the assembly and away from each other. Attaching holes 17' in rear flange 13' (as well as the side flange) are therefor easily accessible for installation of screws 40'. Whereas the first alternative embodiment results in bracket 10 having a more aesthetically pleasing appearance when installed, this second alternative embodiment facilitates easier installation of bracket 10'.

Of course, it is understood that the above is merely a preferred embodiment of the invention and that various changes and alternatives can be made without departing from the spirit and broader aspects of the invention as set forth in the appended claims which are to be interpreted in accordance with the principles of patent law, including the doctrine of equivalents.

The embodiments of the invention in which an exclusive property or privilege is claimed are defined as follows.

1. A fitting room mirror assembly for installation in a fitting room having a first wall and a second wall adjacent to said first wall, including two mirror brackets, one of which is located above the other and each of which is attached to both said first wall and said second wall, for supporting a mirror between said mirror brackets, the improvement in said assembly comprising:

each of said mirror brackets comprising a generally flat nonapertured plate made of a material of sufficient strength and rigidity to support a mirror, said plate being generally triangular in shape defined by a first edge, a second edge, and a third edge;

securing means for securing said first edge and said second edge of said plate to said first wall and said second wall of a fitting room respectively;

and receiving means on said third edge of said plate for receiving and supporting an edge of said mirror, said third edge of said plate being substantially the same length as said edge of said mirror to be supported thereby.

2. The fitting room mirror assembly of claim 1 in which the corner point formed by the intersection of said first edge and said second edge on said plate fits sufficiently snugly into the corner formed by said first wall and said second wall so as to prevent tags and labels from passing between said corner point and said first wall or said second wall.

3. The fitting room mirror assembly of claim 2 in which said first and second edges are, for a short distance from said corner point, trimmed back a distance not to exceed the thickness of said plate so as to define a gap between said trimmed edge portions and the walls of a fitting room to allow for non-square corners in a fitting room.

4. The fitting room mirror assembly of claim 3 in which said receiving means comprises a channel defined by a third flange running along said third edge of said plate, said third flange being generally perpendicular to said plate and extending away from said plate in a first direction, and an angle iron attached to said plate and including a freestanding flange parallel to said third flange, said channel being of a width so as to receive said mirror.

5. The fitting room mirror assembly of claim 4 in which said freestanding flange of said angle iron extends beyond said third flange.

6. The fitting room mirror assembly of claim 5 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in said first direction.

7. The fitting room mirror assembly of claim 6 in which said fastening means comprises a plurality of holes in both said first and second flanges and screws passing through said holes and into said first and second walls fastening said first and second flanges to said first and second walls respectively.

8. The fitting room mirror assembly of claim 7 in which said holes are located in said first and second flanges farther from said plate than the terminal edge of said freestanding flange of said angle iron.

9. The fitting room mirror assembly of claim 5 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in a second direction, said second direction being generally opposite to said first direction.

10. The fitting room mirror assembly of claim 9 in which said fastening means comprises a plurality of holes in both said first and second flanges and screws passing through said holes and into said first and second walls fastening said first and second flanges to said first and second walls respectively.

11. The fitting room mirror assembly of claim 1, 2 or 3 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate.

12. The fitting room mirror assembly of claim 11 in which said fastening means comprises a plurality of holes in both said first and second flanges and screws passing through said holes and into said first and second walls fastening said first and second flanges to said first and second walls respectively.

13. The fitting room mirror assembly of claim 1, 2 or 3 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in a second direction, said second direction being generally opposite to said first direction.

14. The fitting room mirror assembly of claim 13 in which said fastening means comprises a plurality of holes in both said first and second flanges and screws passing through said holes and into said first and second walls fastening said first and second flanges to said first and second walls respectively.

15. The fitting room mirror assembly of claim 1 in which said receiving means comprises a channel defined by a third flange running along said third edge of said plate, said third flange being generally perpendicular to said plate and extending away from said plate in a first direction, and an angle iron attached to said plate and including a freestanding flange parallel to said third flange, said channel being of a width so as to receive said mirror.

16. The fitting room mirror assembly of claim 15 in which said freestanding flange of said angle iron extends beyond said third flange.

17. The fitting room mirror assembly of claim 16 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in said first direction.

18. The fitting room mirror assembly of claim 17 in which said fastening means comprises a plurality of holes in both said first and second flanges and screws passing through said holes and into said first and second walls fastening said first and second flanges to said first and second walls respectively.

19. The fitting room mirror assembly of claim 18 in which said holes are located in said first and second flanges farther from said plate than the terminal edge of said freestanding flange of said angle iron.

20. The fitting room mirror assembly of claim 16 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in a second direction, said second direction being generally opposite to said first direction.

21. The fitting room mirror assembly of claim 20 in which said fastening means comprises a plurality of holes in both said first and second flanges and screws passing through said holes and into said first and second walls fastening said first and second flanges to said first and second walls respectively.

22. The fitting room mirror assembly of claim 15 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in said first direction.

23. The fitting room mirror assembly of claim 22 in which said fastening means comprises a plurality of holes in both said first and second flanges and screws passing through said holes and into said first and second walls fastening said first and second flanges to said first and second walls respectively.

24. The fitting room mirror assembly of claim 23 in which said holes are located in said first and second flanges farther from said plate than the terminal edge of said freestanding flange of said angle iron.

25. The fitting room mirror assembly of claim 15 in which said securing means comprises a first flange running along said first edge of said plate and fastening means to fasten said first flange to said first wall and a second flange running along said second edge of said plate and fastening means to fasten said second flange to said second wall, said first and second flanges being generally perpendicular to said plate and extending away from said plate in a second direction, said second direction being generally opposite to said first direction.

26. The fitting room mirror assembly of claim 25 in which said fastening means comprises a plurality of holes in both said first and second flanges and screws passing through said holes and into said first and second walls fastening said first and second flanges to said first and second walls respectively.

* * * * *